US009983516B2

(12) United States Patent
Takahashi et al.

(10) Patent No.: US 9,983,516 B2
(45) Date of Patent: May 29, 2018

(54) ROLLER FOR ELECTROPHOTOGRAPHY AND PRODUCTION METHOD THEREOF, AND ELECTROPHOTOGRAPHIC IMAGE FORMING APPARATUS

(71) Applicant: CANON KABUSHIKI KAISHA, Tokyo (JP)

(72) Inventors: Hirobumi Takahashi, Suntou-gun (JP); Yoshimasa Sawada, Mishima (JP); Shoji Inoue, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 142 days.

(21) Appl. No.: 15/001,543

(22) Filed: Jan. 20, 2016

(65) Prior Publication Data

US 2016/0223952 A1 Aug. 4, 2016

(30) Foreign Application Priority Data

Jan. 30, 2015 (JP) ..... 2015-016392

(51) Int. Cl.
*G03G 15/16* (2006.01)

(52) U.S. Cl.
CPC ..... *G03G 15/162* (2013.01); *G03G 15/1685* (2013.01)

(58) Field of Classification Search
None
See application file for complete search history.

(56) References Cited

U.S. PATENT DOCUMENTS

| | | | | |
|---|---|---|---|---|
| 4,043,658 | A | 8/1977 | Inoue et al. | |
| 4,495,264 | A | 1/1985 | Takahashi et al. | |
| 4,551,404 | A | 11/1985 | Hiro et al. | |
| 4,615,963 | A | 10/1986 | Matsumoto et al. | |
| 4,615,965 | A | 10/1986 | Matsumoto et al. | |
| 4,717,636 | A | 1/1988 | Takahashi et al. | |
| 7,171,142 | B2 | 1/2007 | Kawakami et al. | |
| 2004/0136753 | A1* | 7/2004 | Kato | G03G 15/0233 399/176 |
| 2006/0280928 | A1* | 12/2006 | Imasaka | B29C 44/08 428/304.4 |
| 2009/0162109 | A1* | 6/2009 | Koyama | G03G 15/0818 399/286 |

(Continued)

FOREIGN PATENT DOCUMENTS

| | | | |
|---|---|---|---|
| JP | 2001-214925 | A | 8/2001 |
| JP | 2010-211020 | A | 9/2010 |

*Primary Examiner* — Erma C Cameron

(74) *Attorney, Agent, or Firm* — Fitzpatrick Cella Harper and Scinto

(57) ABSTRACT

A roller for electrophotography that has a low electric resistance value and that is still further reduced in contaminating property of other member is provided. The roller includes an electro-conductive mandrel and a surface layer having an electro-conductive foam. The electro-conductive foam includes a vulcanized product of an unvulcanized rubber composition including an acrylonitrile-butadiene rubber and a hydrin rubber. The vulcanized product has a matrix-domain structure having a sea phase and an island phase, contains ethylene oxide of 8.0% by mass or more and 20.0% by mass or less based on a total amount of the vulcanized product, and has a spin-spin relaxation time T2 of 750 μs<T2<930 μs.

7 Claims, 3 Drawing Sheets

(56) References Cited

U.S. PATENT DOCUMENTS

2013/0236213 A1* 9/2013 Yamauchi ..... G03G 5/14708
399/159
2013/0315620 A1* 11/2013 Kikuchi ..... G03G 15/751
399/111

* cited by examiner

ROLLER FOR ELECTROPHOTOGRAPHY AND PRODUCTION METHOD THEREOF, AND ELECTROPHOTOGRAPHIC IMAGE FORMING APPARATUS

BACKGROUND OF THE INVENTION

Field of the Invention

The present invention relates to a roller for electrophotography for use in an electrophotographic image forming apparatus and a production method thereof. The present invention also relates to an electrophotographic image forming apparatus.

Description of the Related Art

An electrophotographic image forming apparatus usually includes an image bearing member like an electrophotographic photosensitive member, a charging member that charges the surface of the image bearing member, an exposure apparatus in which the surface of the image bearing member is irradiated with light modulated depending on image information, a developing member that performs development by a developer (toner) to form a visible image (toner image) on the image bearing member, and a transfer member that transfers the visible image on the image bearing member, to a recording material.

In the electrophotographic image forming apparatus, a roller for electrophotography like a transfer roller, which transfers the toner image from the surface of the image bearing member to the surface of the recording material, is used. Such a roller for electrophotography includes a roller for electrophotography including an electro-conductive mandrel and a surface layer that is formed on the outer periphery of the electro-conductive mandrel and that includes an electro-conductive foam.

Japanese Patent Application Laid-Open No. 2010-211020 discloses use of a rubber composition in such an electro-conductive rubber layer of the transfer roller, the composition having a sea-island structure in which an island phase of a rubber component B mainly including an epichlorohydrin rubber is dispersed in a sea phase of a rubber component A mainly including acrylonitrile-butadiene, wherein the area ratio of the island phase, and the proportion of an island phase having a predetermined shape in the entire island phase area are in specific ranges. Then, the following is disclosed: such a transfer roller, in which electro-conductivity of the rubber layer depends on electro-conductivity of the polymer chain itself of the rubber, thus exerts the effect of less causing other member in abutment with the transfer roller to be contaminated due to bleeding of an ion conductive agent onto the surface of the transfer roller.

The present invention is directed to providing a roller for electrophotography that has a high electro-conductivity, namely, a low electric resistance value, and that is still further reduced in contaminating property of other member, as well as a method for producing the roller for electrophotography. The present invention is also directed to providing an electrophotographic image forming apparatus that serves for formation of a high-quality electrophotographic image.

SUMMARY OF THE INVENTION

According to one aspect of the present invention, there is provided a roller for electrophotography including an electro-conductive mandrel and a surface layer having an electro-conductive foam, wherein the electro-conductive foam includes a vulcanized product of an unvulcanized rubber composition including an acrylonitrile-butadiene rubber and a hydrin rubber, the hydrin rubber includes an epichlorohydrin/ethylene oxide/allyl glycidyl ether terpolymer, the vulcanized product has a matrix-domain structure having a sea phase and an island phase, the sea phase containing a vulcanized acrylonitrile-butadiene rubber, and the island phase containing a vulcanized hydrin rubber, the vulcanized product contains ethylene oxide of 8.0% by mass or more and 20.0% by mass or less based on a total amount of the vulcanized product, and the vulcanized product has a spin-spin relaxation time T2, determined by pulse NMR measurement with a hydrogen nucleus as a measurement nucleus, of: 750 μs<T2<930 μs.

According to another aspect of the present invention, there is provided an electrophotographic apparatus including the roller for electrophotography.

According to still another aspect of the present invention, there is provided a method for producing a roller for electrophotography including an electro-conductive mandrel and a surface layer having an electro-conductive foam, the method including the following steps (1) to (3) or the following steps (1), (4) to (6), (1) providing an unvulcanized rubber composition including an acrylonitrile-butadiene rubber, a hydrin rubber including an epichlorohydrin/ethylene oxide/allyl glycidyl ether terpolymer, sulfur and a thiuram type vulcanization accelerator, (2) forming a layer of the unvulcanized rubber composition around a mandrel, (3) vulcanizing and foaming the layer of the unvulcanized rubber composition, thereby forming the surface layer including the electro-conductive foam including a vulcanized product of the unvulcanized rubber composition to provide the roller for electrophotography, (4) obtaining the unvulcanized rubber composition having a tube shape, (5) vulcanizing and foaming the unvulcanized rubber composition having the tube shape, thereby providing a rubber tube including the vulcanized product of the unvulcanized rubber composition, and (6) pressing the mandrel into the rubber tube to provide a roller for electrophotography having the surface layer around the mandrel; wherein, the unvulcanized rubber composition provide a vulcanized product resulting from the step (3) or the step (5), the vulcanized product: having a matrix-domain structure including a sea phase and an island phase, the sea phase containing a vulcanized acrylonitrile-butadiene rubber and the island phase containing a vulcanized hydrin rubber, containing ethylene oxide of 8.0% by mass or more and 20.0% by mass or less based on a total amount of the vulcanized product, and having a spin-spin relaxation time T2, determined by pulse NMR measurement with a hydrogen nucleus as a measurement nucleus, of: 750 μs<T2<930 μs.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

According to studies by the present inventors, even the transfer roller disclosed in Japanese Patent Application Laid-Open No. 2010-211020, if being in contact with the image bearing member in the standing state for a long period, may cause a component like a low molecular rubber component to be bled out from a layer including a rubber forming the transfer roller depending on the surrounding environment, causing the component to be attached to the surface of other member like the image bearing member. The present inventors have then made intensive studies about such a problem, and as a result, have found that the roller for electrophotography having the configuration according to the present invention is effective for solving the above problem.

Hereinafter, embodiments for carrying out the present invention are described.

One aspect of the roller for electrophotography according to the present invention includes an electro-conductive mandrel and a surface layer having an electro-conductive foam.

The electro-conductive foam includes a vulcanized product of an unvulcanized rubber composition including an acrylonitrile-butadiene rubber and a hydrin rubber.

The hydrin rubber includes an epichlorohydrin/ethylene oxide/allyl glycidyl ether terpolymer.

Furthermore, the vulcanized product has a sea-island structure (hereinafter, also referred to as "matrix-domain structure") having a sea phase (hereinafter, also referred to as "matrix") including the vulcanized acrylonitrile-butadiene rubber and an island phase (hereinafter, also referred to as "domain") including the vulcanized hydrin rubber.

Furthermore, the content of ethylene oxide in the vulcanized product is 8.0% by mass or more and 20.0% by mass or less relative to the vulcanized product.

Furthermore, the vulcanized product has a spin-spin relaxation time T2 of 750 μs<T2<930 μs determined by pulse NMR measurement with a hydrogen nucleus as a measurement nucleus.

Figure 1:
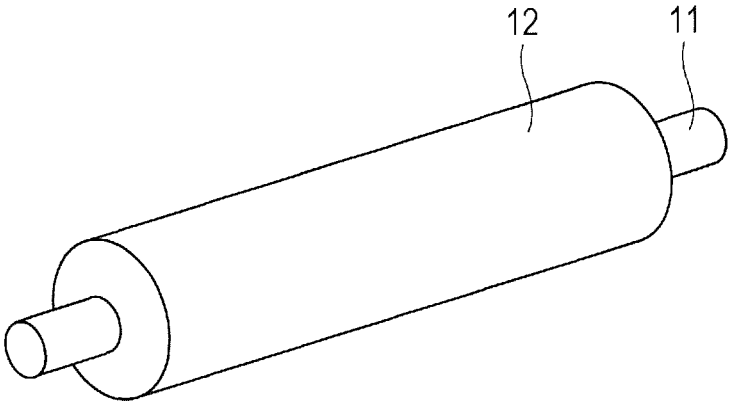
FIG. 1 is a schematic perspective view illustrating one example of the entire configuration of a transfer roller according to one aspect of the present invention.

FIG. 1 is a perspective view illustrating one example of a configuration of a transfer roller according to one embodiment of the present invention, and the transfer roller includes a columnar mandrel 11 and a surface layer 12 that covers the outer periphery of the columnar mandrel 11 and that has an electro-conductive foam.

(Mandrel)

The mandrel can be made of a metal such as aluminum, an aluminum alloy, stainless steel or iron. Such a metal may also be subjected to a plating treatment with chromium, nickel or the like in order to enhance corrosion resistance and wear resistance. The shape of the mandrel may be any of a hollow shape and a solid shape. The outer diameter of the mandrel can be appropriately selected depending on the relationship with an electrophotographic image forming apparatus to be used. As one example, the outer diameter is 4 mm to 10 mm.

(Surface Layer)

The surface layer includes a vulcanized product of an unvulcanized rubber composition including an acrylonitrile-butadiene rubber (hereinafter, sometimes designated as "NBR") and a hydrin rubber including an epichlorohydrin/ethylene oxide/allyl glycidyl ether terpolymer (hereinafter, sometimes designated as "GECO").

(Matrix-Domain Structure: Matrix Including Crosslinked NBR and Domain Including Crosslinked GECO)

Figure 2:
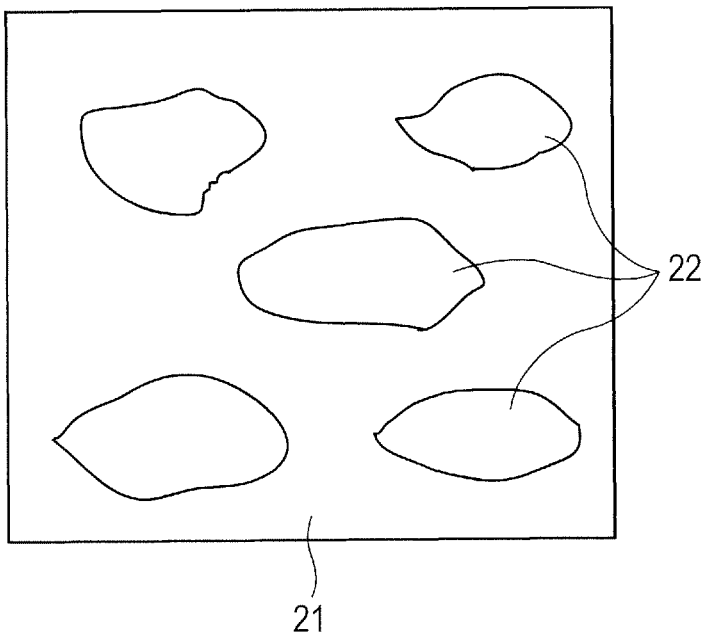
FIG. 2 is a view of a matrix-domain structure having NBR as a sea phase and GECO as an island phase.

As illustrated in FIG. 2, the vulcanized product, included in the electro-conductive foam in the surface layer, has a matrix-domain structure having a matrix 21 including crosslinked NBR and a domain 22 including crosslinked GECO. That is, the vulcanized product has a structure so that domains are dotted in a matrix forming a continuous phase.

In the vulcanized product, the spin-spin relaxation time T2 determined by pulse NMR measurement with a hydrogen nucleus as a measurement nucleus is in the range of 750 μs<T2<930 μs. Herein, T2 is more preferably 800 μs or more and 900 μs or less.

The vulcanized product may inevitably include various impurities such as a vulcanizing residue and a foaming residue in the rubber in the course of production. Among such impurities, a polar substance that easily contaminates the image bearing member has a high affinity to GECO higher in polarity, in the vulcanized product.

GECO has a small number of crosslinking points as compared with NBR, and therefore is high in molecular mobility of the rubber and has difficulty in allowing impurities to be held in the rubber. In the present aspect, a matrix-domain structure, in which a phase including crosslinked GECO is defined as a domain and is surrounded by a matrix including crosslinked NBR having a relatively large number of crosslinking points, is adopted to thereby allow impurities to be incorporated in the phase including crosslinked GECO, thereby inhibiting impurities from being bled to the outer surface of the surface layer.

(Spin-Spin Relaxation Time)

The spin-spin relaxation time T2 of the vulcanized product, measured by pulse NMR measurement with a hydrogen nucleus as a measurement nucleus, represents the molecular mobility of the rubber.

The molecular mobility and the degree of crosslinking are correlative to each other, and a larger T2 value means weaker crosslinking and a smaller T2 value means stronger crosslinking.

The T2 of the vulcanized product can be set to be more than 750 microseconds (μs) and less than 930 μs, thereby certainly inhibiting impurities from being bled out from the vulcanized product while maintaining flexibility of the vulcanized product. That is, the T2 value of the vulcanized product serves as an index indicating the degree of crosslinking of the crosslinked NBR forming the matrix of the vulcanized product. The T2 value is in the above range to thereby make impurities in the domain difficult to pass through the matrix surrounding the domain. Thus, it is considered that impurities from the domain are difficult to bleed on the surface of the surface layer. The method for adjusting the spin-spin relaxation time T2 of the vulcanized product in the present invention is described later.

(Unvulcanized Rubber Composition)

(Unvulcanized Rubber)

The unvulcanized rubber composition includes an unvulcanized hydrin rubber including unvulcanized NBR and an unvulcanized hydrin rubber including unvulcanized GECO. Herein, each of NBR and GECO can be used in combinations of two or more.

The phase separation state of the vulcanized product can be controlled by adjustment of the contents of NBR and the hydrin rubber in the unvulcanized rubber composition.

In order to form a matrix-domain structure having a matrix including crosslinked NBR and a domain including a crosslinked hydrin rubber in a crosslinked product, the mixing ratio (NBR/GECO; mass basis) of the unvulcanized NBR to the unvulcanized GECO included in the unvulcanized rubber composition is 1 or more, in particular, 1.2 or more, as a target.

The boundary value of the mixing ratio, which enables the matrix-domain structure to be formed in the crosslinked product, however, is varied depending on the specific gravities and viscosities of NBR and GECO. For example, when "Nipol DN401LL" (trade name; produced by Zeon Corporation, Mooney viscosity: 32, specific gravity: 0.94) is used for NBR and "Epion 301" (trade name, (produced by Daiso Co., Ltd. (new corporate name: Osaka Soda Co., Ltd.)), Mooney viscosity: 60, specific gravity: 1.20), "Epichlomer CG102" (trade name, produced by Daiso Co., Ltd., Mooney viscosity: 55, specific gravity: 1.24) or "Hydrin T3016S" (trade name; produced by Zeon Corporation, Mooney viscosity: 60, specific gravity: 1.31) is used for GECO, a matrix-domain structure having a matrix including crosslinked hydrin and a domain including crosslinked NBR may be formed in the vulcanized product even in a mixing ratio NBR/GECO of 1.5.

Therefore, in order to use NBR and GECO described above to stably provide a crosslinked product having a matrix-domain structure having a domain including a crosslinked hydrin rubber and a matrix including crosslinked NBR, the mixing ratio NBR/GECO can be 1.8 or more, in particular, 2.1 or more. Herein, the upper limit of the mixing ratio NBR/GECO in such a combination of NBR and GECO, but not particularly limited, can be 3.5 or less, in particular, 2.8 or less from the viewpoint of stable formation of the matrix-domain structure.

The uncrosslinked NBR is not particularly limited, and can be NBR having an average content of acrylonitrile of 15% by mass or more and 20% by mass or less. Acrylonitrile has electro-conductivity, and also affects the mobility of a polymer molecular chain. When the content of acrylonitrile is 15% by mass or more, the electric resistance value is not high. When the content is 20% by mass or less, a proper content of butadiene for achieving a sufficient degree of crosslinking by vulcanization can be ensured. NBR in which the average content of acrylonitrile is in the above range achieves both of such factors in a well-balanced manner.

Herein, the center value of the amount of bonded acrylonitrile in above "Nipol DN401LL" is 18.0% (catalog value).

(Content of Ethylene Oxide)

The resistance value of the electro-conductive foam is varied depending on the amount of ethylene oxide included in the vulcanized product in the electro-conductive foam.

For example, when the roller for electrophotography according to the present invention is used for a transfer roller that transfers a toner image from the surface of the image bearing member to the surface of a recording material like a paper, the electric resistance value of the transfer roller, when the roller resistance value obtained by a method described later is defined as R [Ω], can be in the range of 6.9 or more and 7.7 or less in terms of Log R.

In order to obtain a roller for electrophotography exhibiting such electro-conductivity, the content of ethylene oxide in the vulcanized product is 8.0% by mass or more and 20.0% by mass or less based on the mass of the vulcanized product. The mass of the vulcanized product here means the sum of the total mass of the rubber in the vulcanized product, and the mass of a vulcanizer like sulfur and the mass of a filler like carbon black. The amounts of a vulcanization accelerator, a vulcanization aid and a foaming agent not forming the substance of the vulcanized product are not included in the mass of the vulcanized product in calculation of the content of ethylene oxide.

The content of ethylene oxide in the vulcanized product can be in the above numerical range to thereby adjust the roller resistance of the transfer roller within the above numerical range. As a result, the transfer rate of the toner image from the image bearing member to the recording material can be still further improved. Excess imparting of charge to toner or the image bearing member due to a too low roller resistance can also be suppressed.

In order to maintain a matrix-domain structure having a matrix including acrylonitrile-butadiene and a domain including a hydrin rubber, and to adjust the roller resistance within the above range, GECO having a high content of ethylene oxide can be used for the hydrin rubber contained in the unvulcanized rubber composition. Specifically, GECO including ethylene oxide in a mass ratio of 30% or more, more preferably 50% or more is used.

(Vulcanizer/Vulcanization Accelerator)

For example, sulfur is used for the vulcanizer.

The content of sulfur in the unvulcanized rubber composition can be 2.5% by mass or more and 4.0% by mass or less based on the total amount of the rubber component in the unvulcanized rubber composition. The amount of sulfur, described later, is a factor that affects the spin-spin relaxation time T2 of the crosslinked product in the present invention, and therefore the actual amount thereof to be used can be appropriately adjusted depending on the type and the amount of the rubber to be used. Herein, a tendency is that the amount of sulfur can be 2.5% by mass or more to thereby sufficiently cure the vulcanized product, and the amount of sulfur can be 4.0% by mass or less to thereby inhibit the T2 in the present invention from being deviated from the range due to a too high degree of crosslinking of the vulcanized product, namely, inhibit the hardness from being too high.

Examples of the vulcanization accelerator can include thiuram type, thiazole type, guanidine type, sulfenamide type, dithiocarbamate type and thiourea type vulcanization accelerators. In particular, a thiuram type vulcanization accelerator is particularly useful because of being highly effective as the vulcanization accelerator for vulcanization of NBR and GECO. Examples of the thiuram type vulcanization accelerator include tetramethylthiuram disulfide (TMTD), tetraethylthiuram disulfide (TETD), tetrabutylthiuram disulfide (TBTD) and tetraoctylthiuram disulfide (TOT), and TETD can be adopted in consideration of the strength of reactivity as the vulcanization accelerator, and the environmental safety.

With respect to the content of the vulcanization accelerator in the unvulcanized rubber composition, the content of the thiuram type vulcanization accelerator can be 1.5% by mass or more and 2.5% by mass or less relative to the rubber component in the unvulcanized rubber composition. When the content is 1.5% by mass or more, a sufficient effect as the vulcanization accelerator can be exerted. When the content is 2.5% by mass or less, vulcanization is not promoted too much, and vulcanization and foaming can be balanced. Therefore, even when a foaming agent described later is used, a desired open cell rate can be imparted to the crosslinked product.

(Foaming Agent)

Examples of the foaming agent contained in the unvulcanized rubber composition include azodicarbonamide, sodium hydrogen carbonate and p,p'-oxybis(benzenesulfonyl hydrazide) (hereinafter, also referred to as "OBSH"). In particular, OBSH can be adopted in consideration of the change in electric resistance value over time and uniformability of a cell size (transfer property of the transfer roller, when the roller for electrophotography is used as the transfer roller).

The total content of the foaming agent can be 2.0 parts by mass or more and 2.5 parts by mass or less based on 100 parts by mass of the rubber component in the unvulcanized rubber composition.

When OBSH is used for the foaming agent, OBSH can be used in which 1.5 parts by mass or more and 2.0 parts by mass or less of OBSH having a median diameter (d50) of 2 μm or more and 5 μm or less, and 0.5 parts by mass or more and 1.0 part by mass or less of OBSH having a median diameter (d50) of 12 μm or more and 16 μm or less are mixed in the above range of the total content. Herein, the median diameter of the foaming agent can be measured by a particle size distribution measurement apparatus (Multisizer 3: manufactured by Beckman Coulter, Inc.).

OBSHs having a different median diameter (d50) can be contained in the unvulcanized rubber composition in specific amounts to be compounded, as described above, thereby allowing the timing of foaming to be changed.

OBSH having a smaller median diameter (d50) allows foaming to be initiated at a lower temperature, to form a cell. Next, OBSH having a larger median diameter (d50) allows foaming to be initiated later, and the cells previously formed by foaming are communicated with each other by foaming between the cells, to thereby result in an enhancement in open cell rate.

OBSH having a smaller median diameter (d50) can be one having a median diameter (d50) of 2 μm or more and 5 μm or less. When the median diameter (d50) is 2 μm or more, the foaming starting temperature is not decreased and the average cell size can be prevented from being increased, and therefore the transfer roller can achieve a predetermined hardness. When the median diameter (d50) is μm or less, the difference in foaming starting temperature between OBSH having a smaller median diameter (d50) and OBSH having a larger median diameter (d50) can be sufficiently ensured, and a high open cell rate can be ensured.

OBSH having a larger median diameter (d50) can be one having a median diameter (d50) of 12 μm or more and 16 μm or less. When the median diameter (d50) is 12 μm or more, the difference in foaming starting temperature between OBSH having a larger median diameter (d50) and OBSH having a smaller median diameter (d50) can be sufficiently ensured, and a high open cell rate can be ensured. When the median diameter (d50) is 16 μm or less, the foaming starting temperature is not too high and vulcanization is not made before communication of the cells.

The content of OBSH in the unvulcanized rubber composition can be 2.0% by mass or more relative to the rubber component, and thus cells that are foamed before vulcanization progresses are communicated with each other, to provide a vulcanized product having a high open cell rate. In addition, while a side reaction which decomposes a thiuram type accelerator as the vulcanization accelerator occurs in the reaction of OBSH, the content of OBSH can be 2.5% by mass or less relative to the rubber component, to thereby effectively suppress inhibition of vulcanization.

Furthermore, when the content of OBSH in the unvulcanized rubber composition is in the range of 2.0% by mass or more and 2.5% by mass or less relative to the rubber component, namely, 2.0 parts by mass or more and, 2.5 parts by mass or less based on 100 parts by mass of the rubber component, as well as when the amount of OBSH having a median diameter (d50) of 12 μm or more and 16 μm or less to be compounded is 0.5 parts by mass or more and 1.0 part by mass or less and the amount of OBSH having a median diameter (d50) of 2 μm or more and 5 μm or less to be compounded is less than 1.5 parts by mass, the number of particles is reduced with respect to a foaming agent having a lower foaming starting temperature in the unvulcanized rubber composition, thereby increasing the distance between particles that initiate foaming at a low temperature. As a result, the open cell rate tends to be reduced.

(Open Cell Rate)

The open cell rate is the proportion of the cell communicated to the surface of the vulcanized product in the entire cell in the vulcanized product, and is determined by the following method.

Figure 4:
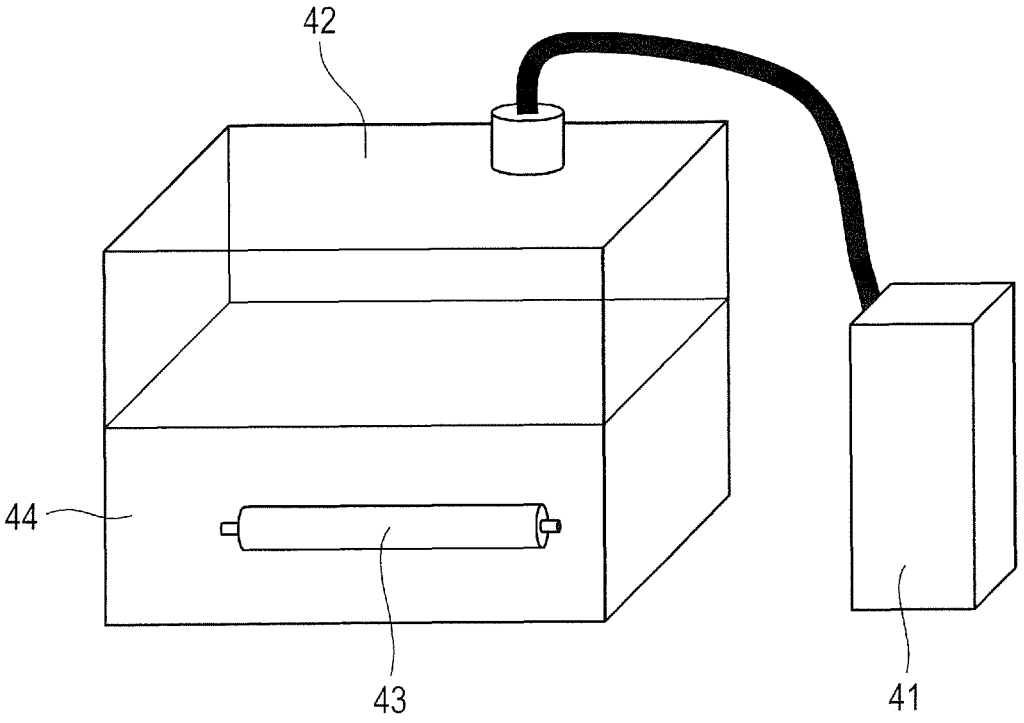
FIG. 4 is a schematic view illustrating an apparatus for open cell rate measurement.

As illustrated in FIG. 4, a roller for electrophotography 43 is entirely immersed in water 44 under a reduced pressure condition of 100 hPa for 15 minutes, and allowed to absorb water. A pressure resistant vessel 42 is depressurized by a vacuum pump 41. When the mass of the roller for electrophotography before water absorption is defined as W1, the mass of the roller for electrophotography after water absorption is defined as W2, the mass of the mandrel 11 is defined as WS, the volume of the vulcanized product (including cells) is defined as V1, the specific gravity (1 g/cm$^3$) of water is defined as Tw, and the material specific gravity of the vulcanized product is defined as Tm, the open cell rate is determined by the following (Expression 1).

$$[(W2-W1)/Tw]/[V1-\{(W1-WS)/Tm\}]\times 100(\%) \quad \text{(Expression 1)}$$

The open cell rate can be 70% or more. When the open cell rate is 70% or more, deterioration in setting property is suppressed. The reason for this is the following: when an independent cell is in the state of being deformed by application of an external force for a long period, air therein gradually comes out through the rubber, and when the force is removed thereafter, the shape can be instantly recovered because cells are communicated with each other at an open cell rate of 70% or more.

(Other Additives)

The unvulcanized rubber composition can contain a vulcanization aid. Examples of the vulcanization aid include zinc oxide, zinc stearate and stearic acid. Zinc stearate and stearic acid can be contained. When zinc oxide is used, resistance stability in a long-term storage tends to be poor, and therefore zinc stearate can be adopted. When stearic acid is added, the unvulcanized rubber composition is reduced in sticking to a roll during kneading and processing thereof, and is excellent in processability.

Besides the above, carbon black, calcium carbonate and the like can also be contained as long as the functions of substances contained in the above composition are not impaired.

(Adjustment of Spin-Spin Relaxation Time T2)

The spin-spin relaxation time T2 of the vulcanized product in the surface layer is an index indicating the degree of crosslinking of the rubber in the vulcanized product, and T2 can be adjusted by adjustment of the degree of crosslinking of the rubber.

Specifically, T2 of the crosslinked product can be changed depending on the amount of sulfur in the unvulcanized rubber composition, the type and the amount of the vulcanization accelerator, and the ratio of the amounts of the unvulcanized NBR and the hydrin rubber.

For example, the amount of each of sulfur and the vulcanization accelerator in the unvulcanized rubber composition can be increased to thereby adjust T2 of the vulcanized product to be shorter.

In addition, the ratio of the hydrin rubber to NBR in the unvulcanized rubber composition can be lower to thereby relatively increase the ratio of the crosslinked NBR having a high degree of crosslinking in the vulcanized product, and as a result, T2 can be adjusted to be shorter. It is to be noted that the ratio of NBR and the hydrin rubber in the unvulcanized rubber composition affects the matrix-domain structure as described above. Therefore, the ratio of the amounts of NBR and hydrin in the unvulcanized rubber composition can be a ratio so as to form the matrix-domain structure having the matrix including the crosslinked NBR and the domain including the crosslinked GECO and furthermore the amount(s) of sulfur or sulfur and the vulcanization accelerator can be adjusted to thereby adjust T2.

More specifically, for example, when 68 parts by mass of "Nipol DN401LL" is used for NBR, and 22 parts by mass of "EPION301" and 10 parts by mass of "Epichlomer CG102" are used for GECO, namely, the NBR/GECO is 2.1, a crosslinked product of an unvulcanized rubber composition in which 3.0 parts by mass of sulfur, and 2.0 parts by mass of tetrathiuram disulfide (trade name: Nocceler TET-G; produced by Ouchi Shinko Chemical Industrial Co., Ltd.) and 1.5 parts by mass of dibenzothiazyl disulfide (trade name: Nocceler DM-P, produced by Ouchi Shinko Chemical Industrial Co., Ltd.) for the vulcanization accelerator are mixed has a T2 of 861 μs.

On the other hand, when the amount of sulfur is 2.0 parts by mass and the amount of "Nocceler TET-G" is 1.5 parts by mass in the above unvulcanized rubber composition, the resulting vulcanized product has a T2 of 971 μs. Furthermore, when the amount of sulfur is 6.0 parts by mass and the amount of "Nocceler TET-G" is 3.0 parts by mass in the above unvulcanized rubber composition, the resulting vulcanized product has a high degree of crosslinking of the rubber and therefore has a T2 of 706 μs.

Furthermore, when 50 parts by mass of "Nipol DN401LL", 0 parts by mass of "EPION301" and 50 parts by mass of "Epichlomer CG102" are used in the above unvulcanized rubber composition, namely, the NBR/GECO is 1.0, the ratio of a hydrin rubber having a low degree of crosslinking in the resulting vulcanized product is increased, and as a result the vulcanized product has a T2 of 1030 μs.

(Production of Roller for Electrophotography)

A method for producing a roller for electrophotography according to the present invention includes the following steps (1) to (3) or the following steps (1), (4) to (6):

(1) providing an unvulcanized rubber composition including: an acrylonitrile-butadiene rubber, a hydrin rubber including an epichlorohydrin/ethylene oxide/allyl glycidyl ether terpolymer, sulfur and a thiuram type vulcanization accelerator, (2) forming a layer of the unvulcanized rubber composition around a mandrel, (3) vulcanizing and foaming the layer of the unvulcanized rubber composition, thereby forming the surface layer including the electro-conductive foam including a vulcanized product of the unvulcanized rubber composition to provide the roller for electrophotography, (4) obtaining the unvulcanized rubber composition having a tube shape, (5) vulcanizing and foaming the unvulcanized rubber composition having the tube shape, thereby providing a rubber tube including the vulcanized product of the unvulcanized rubber composition, and (6) pressing the mandrel into the rubber tube to provide a roller for electrophotography having the surface layer around the mandrel.

The unvulcanized rubber composition provides a vulcanized product resulting from the step (3) or the step (5).

The vulcanized product has a matrix-domain structure including a sea phase and an island phase, the sea phase containing a vulcanized acrylonitrile-butadiene rubber, and the island phase containing a vulcanized hydrin rubber.

The vulcanized product contains ethylene oxide of 8.0% by mass or more and 20.0% by mass or less based on a total amount of the vulcanized product.

Further, the vulcanized product has a spin-spin relaxation time T2, determined by pulse NMR measurement with a hydrogen nucleus as a measurement nucleus, of: 750 μs<T2<930 μs.

One example of the method for producing the roller for electrophotography according to the present invention includes the following.

First, unvulcanized rubber composition, which provides a vulcanized product according to the present invention, is provided. For example, the unvulcanized rubber like NBR and GECO, sulfur, and if required, a vulcanization aid, are kneaded with a closed type kneading machine such as a Banbury mixer or a kneader. Thereafter a foaming agent, and if required, sulfur, and a vulcanization accelerator are further added and kneaded with an open roll. Thereafter, the kneaded product is sheeted in the form of a ribbon by a ribbon shaping and sheeting machine, to obtain an unvulcanized rubber composition in the form of ribbon. Then, the unvulcanized rubber composition in the form of ribbon, is loaded to an extruder, and extruded in the form of a tube to provide an unvulcanized rubber composition having a tube shape. Next, the unvulcanized rubber composition having a tube shape is vulcanized and foamed to provide a foamed rubber tube including a vulcanized product of the unvulcanized rubber composition.

The vulcanization and foaming may be performed by appropriately selecting any known unit such as a microwave vulcanization apparatus, a hot air vulcanization apparatus, an electric furnace and a vulcanization can.

In particular, a vulcanization apparatus including a microwave vulcanization apparatus can be adopted because of easily providing a uniform electro-conductive foam.

The resulting foamed rubber tube is, if necessary, cut to a desired dimension, and thereafter the mandrel 11 is pressed thereinto. The cutting may be made before or after the vulcanization and foaming. The method of securing the rubber tube and the mandrel 11 includes a method of coating the mandrel 11 with an electro-conductive adhesive and a method of pressing the mandrel 11 having a larger outer diameter than the inner diameter of the rubber tube, into the rubber tube, and may be appropriately selected. Furthermore, after the mandrel 11 is pressed into the rubber tube, both ends of the resultant may be, if necessary, cut to a desired length. The rubber tube, into which the mandrel 11 is pressed, is polished by a polishing machine to produce a transfer roller having an electro-conductive foam 12 on the outer circumference of the mandrel 11.

(Electrophotographic Image Forming Apparatus)

Figure 6:
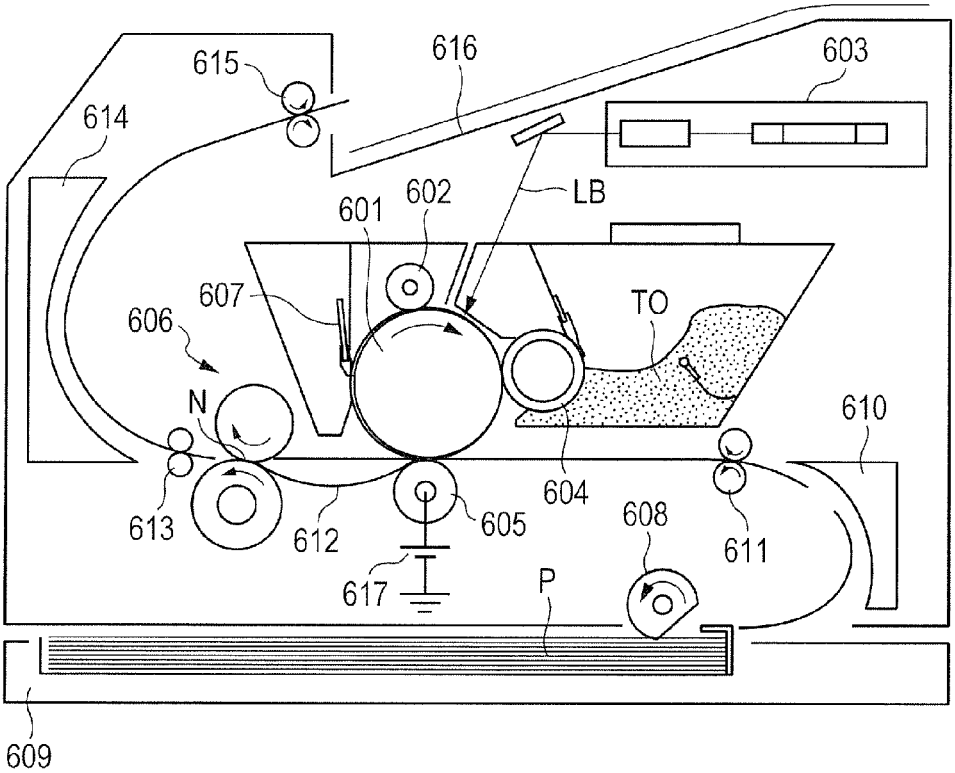
FIG. 6 is a schematic view illustrating one example of a configuration of the electrophotographic image forming apparatus according to the present invention.

FIG. 6 is a schematic view of one example of the electrophotographic image forming apparatus according to the present invention. The electrophotographic image forming apparatus is an electrophotographic laser printer (hereinafter, also designated as "printer").

The printer has a drum-shaped electrophotographic photosensitive member (hereinafter, designated as "photosensitive drum") 601 as the image bearing member. Examples of the photosensitive drum 601 include an organic photosensitive drum (OPC).

The photosensitive drum 601 is rotated at a predetermined peripheral velocity (process speed) in the arrow direction (clockwise direction in FIG. 6) in response to a printing instruction output from an external apparatus such as a host computer or a terminal on a network. The outer periphery (surface) of a photosensitive drum 601 is evenly charged at predetermined polarity/potential by a charging roller 602 as a charging unit in the course of the rotation.

The surface of the photosensitive drum 601 is scanned and exposed by a laser beam LB modulated and controlled (ON/OFF control) depending on image information from the external apparatus, which is output from a laser beam scanner 603 as a scanning exposure apparatus. Thus, an electrostatic latent image (electrostatic image) is formed on the surface of the photosensitive drum 601 depending on the intended image information. The electrostatic latent image is attached to toner (developer) TO by a developing apparatus 604 as a developing unit and developed as a toner image (developed image). As the developing method, a jumping developing method, a two-component developing method, a FEED developing method (Floating Electrode Effect Developing) or the like is used, and is often used in combination of image exposure and reversal development.

On the other hand, a recording material P loaded and accommodated in a feed cassette 609 is fed out one by one by rotation of a feed roller 608, and conveyed to a resist roller 611 through a sheet path having a guide 610. The resist roller 611 feeds the recording material P to a transfer nip portion between the surface of the photosensitive drum 601 and the outer periphery (surface) of a transfer roller 605 at a predetermined control timing. The recording material P is sandwiched and conveyed on the transfer nip portion, and in the course of such conveyance, the toner image on the surface of the photosensitive drum 601 is sequentially transferred to the recording material P by a transfer bias applied to the transfer roller 605 by a power source 617 connected to the transfer roller 605. Thus, the recording material P bears an unfixed toner image. The roller for electrophotography according to the present invention is here used as the transfer roller 605.

The recording material P bearing the unfixed toner image (unfixed image) is sequentially separated from the surface of the photosensitive drum 601, discharged from the transfer nip portion, and introduced into a nip portion N of a fixing apparatus (fixer) 606 through a conveyance guide 612. The recording material P then passes through the nip portion N to thereby allow the toner image to be heated and fixed on the surface of the recording material P. The recording material P exiting from the fixing apparatus 606 passes through a sheet path having a conveyance roller 613, a guide 614 and a discharge roller 615, and is discharged out on a discharge tray 616.

The surface of the photosensitive drum 601, from which the recording material P is separated, is subjected to a removal treatment of contaminants attached, such as transfer residue toner, by a cleaning apparatus 607 as a cleaning unit for cleaning, and the photosensitive drum 601 is subjected to image formation repeatedly.

EXAMPLES

Next, the present invention is described in more detail with reference to Examples, but the present invention is not limited to such Examples.

Example 1

Preparation of Unvulcanized Rubber Composition

<Filler 1> and <vulcanization aid 1> were added to <unvulcanized rubber 1>, and kneaded using a 7-L closed type kneader (trade name: WDS7-30: manufactured by Nihon Spindle Manufacturing Co., Ltd. (previous corporate name: Moriyama Corporation)) at a number of rotor rotation of 30 rpm for 7 minutes.

<Unvulcanized Rubber 1>

Acrylonitrile-butadiene rubber (Nipol DN401LL: Zeon Corporation)

68 parts by mass

Epichlorohydrin/ethylene oxide/allyl glycidyl ether terpolymer containing 56.7% by mass of ethylene oxide (EPION301: Daiso Co., Ltd. (new corporate name: Osaka Soda Co., Ltd.))

22 parts by mass

Epichlorohydrin/ethylene oxide/allyl glycidyl ether terpolymer containing 37.2% by mass of ethylene oxide (Epichlomer CG102: Daiso Co., Ltd. (new corporate name: Osaka Soda Co., Ltd.)):

10 parts by mass

<Filler 1>

Carbon black (Asahi #35G: Asahi Carbon Co., Ltd.)

45 parts by mass

<Vulcanization Aid 1>

Zinc stearate (zinc stearate: NOF Corporation)

3.0 parts by mass

Stearic acid (stearic acid "Tsubaki": NOF Corporation)

1.0 part by mass

After kneading, <foaming agent 1>, <vulcanizer 1> and <vulcanization accelerator 1> were added, and kneaded and dispersed by use of a 12-inch open roll (Kansai Roll Co., Ltd.) for 15 minutes while being cooled so that the temperature of an unvulcanized rubber composition was kept at 80° C. or lower. Finally, the resultant was made into a ribbon shape and taken out to prepare an unvulcanized rubber composition for an electro-conductive foam.

<Vulcanizer 1>

Sulfur (Sulfax PMC Tsurumi Chemical Industries Co., Ltd.)

3.0 parts by mass

<Vulcanization Accelerator 1>

Tetraethylthiuram disulfide (Nocceler TET-G: Ouchi Shinko Chemical Industrial Co., Ltd.)

2.0 parts by mass

Dibenzothiazyl disulfide (Nocceler DM-P: Ouchi Shinko Chemical Industrial Co., Ltd.):

1.5 parts by mass

<Foaming Agent 1>

OBSH having a median diameter of 5.0 μm (Neocellborn N#1000M: Eiwa Chemical Ind. Co., Ltd.)

2.0 parts by mass

OBSH having a median diameter of 16.0 μm (Neocellborn N#1000S: Eiwa Chemical Ind. Co., Ltd.)

0.5 parts by mass (Production of Roller for Electrophotography)

Figure 5:
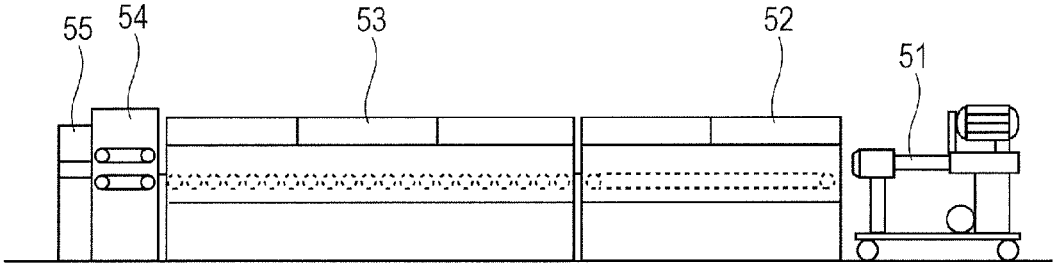
FIG. 5 is a schematic view illustrating one example of a configuration of a vulcanization apparatus for use in production of a roller for electrophotography according to the present invention.

The production apparatus illustrated in FIG. 5 was used to extrude the ribbon shaped unvulcanized rubber composition for an electro-conductive foam to a tube shape by an extruder 51 (60-mm vent-type rubber extruder, Mitsuba MFG. Co., Ltd.).

The resultant was vulcanized and foamed by a vulcanization apparatus (manufactured by Micro Denshi Co., Ltd.) including a 3.0-kW microwave vulcanization apparatus 52, to produce a rubber tube.

The microwave vulcanization apparatus 52 was set as follows: frequency: 2450±50 MHz, output: 0.6 kW, and inner furnace temperature: 180° C. The rubber tube was vulcanized and foamed in the microwave vulcanization apparatus 52, and thereafter further vulcanized and foamed in a hot air vulcanization apparatus 53 in which the inner furnace temperature was set at 200° C.

The rubber tube vulcanized and foamed had an outer diameter of about 14.0 mm and an inner diameter of about 4.0 mm. The rubber tube was conveyed at a rate of 2.0 m/min in the microwave vulcanization apparatus and the hot air vulcanization apparatus by a haul-off machine 54. The length of the microwave vulcanization apparatus 52 was about 4 m, the length of the hot air vulcanization apparatus 53 was about 6 m and the length of the haul-off machine 54 was about 1 m. That is, the time taken for passing in the microwave vulcanization apparatus was about minutes, the time taken for passing in the hot air vulcanization apparatus was about 3 minutes and the time taken for passing in the haul-off machine was about 30 seconds.

After vulcanization and foaming, a regular length cutter 55 was used to cut the rubber tube to a length of 250 mm, a mandrel 11 having an outer diameter of 5 mm was pressed into the rubber tube, and thereafter both ends of the resultant were cut to provide a roller having a rubber length of 216 mm. The outer periphery of the roller was polished at a rotation speed of 1800 rpm and a feeding speed of 800 mm/min so that the outer diameter was 12.5 mm, thereby producing a roller for electrophotography in which the outer periphery of the mandrel was covered with a surface layer including an electro-conductive foam.

(Physical Properties of Roller for Electrophotography)

(Observation of Matrix-Domain Structure)

A crosslinked product sample having a length of 3 mm, a width of 3 mm and a thickness of 5.0 μm was cut out from the surface layer of the roller for electrophotography by use of a knife for ultrathin section (trade name: DiATOME diamond knife, manufactured by Nisshin EM Corporation). The crosslinked product sample was fixed on a sample stage of a scanning electron microscope (trade name: Ultraplus; manufactured by Carl Zeiss Co., Ltd.) by use of a carbon double-sided tape (produced by Nisshin EM Corporation) for SEM, in which an aluminum substrate was used.

An image of the crosslinked product sample was taken at an acceleration voltage of 1 kV and 5000 magnifications.

The reflected electron image obtained was visually observed with respect to the presence of a closed region having an area, namely, a domain.

When the closed region having an area was confirmed in the reflected electron image, a portion of the crosslinked product sample, corresponding to the closed region, was analyzed at an acceleration voltage of 6 kV and a working distance of 8 mm by use of an energy dispersive X-ray analyzer (trade name: Noran System 7, manufactured by Thermo Fisher Scientific K. K.), and the presence of a chlorine atom therein was confirmed. When the presence of a chlorine atom could be confirmed in the closed region, the closed region was determined to be a domain including a crosslinked hydrin rubber, and the matrix-domain structure in the present invention was assumed to be formed.

(Spin-Spin Relaxation Time)

A pulse NMR apparatus (JEOL Ltd., trade name: JNM-MU25A) was used for measurement of the spin-spin relaxation time: T2 of the electro-conductive foam. A crosslinked product sample was cut out from the surface layer as in the case of observation of the matrix-domain structure, the crosslinked product sample was filled in a measurement cell, and the spin-spin relaxation time T2 was measured. Herein, such measurement was performed by pulse NMR with a hydrogen nucleus as a measurement nucleus, and T2 was determined from an echo intensity obtained using a solid echo method. The measurement conditions were as follows: measurement frequency: 20 MHz, pulse width: 2.0 μsec, pulse interval: 8 μsec, measurement temperature: 50° C., and cumulative number: 128.

(Open Cell Rate)

The open cell rate was determined by the (Expression 1).

(Roller Resistance Value)

Another roller for electrophotography different from the roller for electrophotography used in observation of physical properties described above, obtained by the above production method, was pressure-bonded to a stainless drum having an outer diameter of 30 mm, 300 g of a load was applied on each of both sides of the mandrel of the roller for electrophotography, and the resultant was driven-rotated at a rate of 30 rpm. In such a state, a direct voltage of 2000 V was applied between the mandrel and the stainless drum, and the current value flowing therebetween was measured. Such measurement was made in a measurement environment of a temperature of 23° C. and a relative humidity of 55%. The current value measured was used to calculate the resistance value according to the law of Ohm. Herein, the resistance value that can be adopted in the transfer roller, when the roller resistance value is defined as R [Ω], is in the range of 6.9 or more and 7.7 or less in terms of Log R.

(Image Evaluation)

The roller for electrophotography subjected to the measurement of the roller resistance value was incorporated as the transfer roller of an electrophotographic type laser printer (trade name: Laser Jet P1606dn, manufactured by HP Inc.). The laser printer was left under an environment of a temperature of 23° C. and a relative humidity of 55% for 24 hours, and thereafter an electrophotographic image was output. The image was a black solid image, the first image after continuous outputting for 5000 sheets was visually observed, and the transfer property and transfer unevenness of toner were rated according to the following criteria.

(Transfer Unevenness of Toner)

A: No transfer unevenness was observed.

B: Slight transfer unevenness was observed.

C: Remarkable transfer unevenness was observed.

(Transfer Property of Toner)

A: Good transfer property.

B: Slightly poor transfer property.

C: Poor transfer property.

Figure 3:
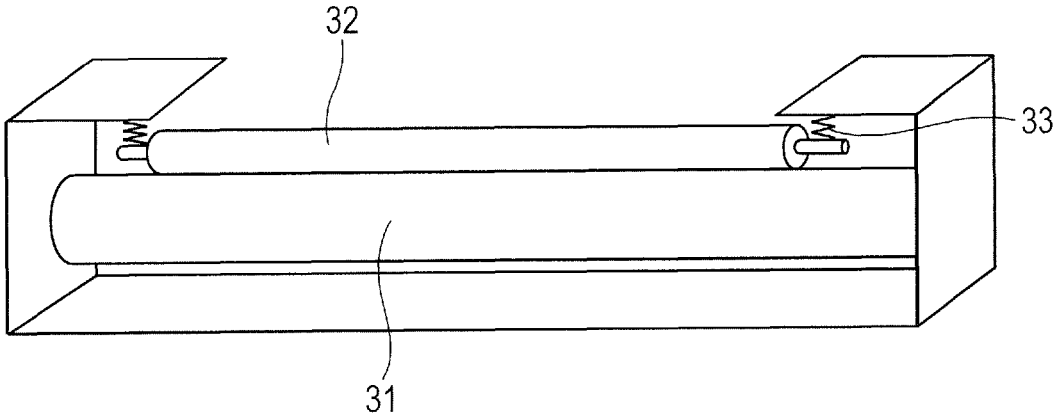
FIG. 3 is a schematic view illustrating a jig that brings a transfer roller into contact with a photosensitive member.

Setting property of the roller for electrophotography and photosensitive member-contaminating property of a component leaked out from the roller for electrophotography were evaluated as follows. A photosensitive drum was taken out from a process cartridge (trade name: Laser Jet CE278A, manufactured by HP Inc.) for use in "Laser Jet P1606dn", fixed to the roller for electrophotography by a jig (see FIG. 3) so that the spring pressure at one side was suppressed to 500 gram-weight, and placed under an environment of a temperature of 40° C. and a relative humidity of 95% for 7 days. Herein, the jig illustrated in FIG. 3 has a configuration so that a spring 33 is disposed at a position corresponding to each of both sides of a roller for electrophotography 32 and the electrophotographic roller 32 can be pressed to a photosensitive drum 31 at a predetermined pressure. Thereafter, each of the roller for electrophotography and the photosensitive drum was incorporated in the process cartridge. The process cartridge was mounted to the laser printer, and an electrophotographic image was formed. The image was a black solid image, the first image output was visually observed, and the properties were rated according the following criteria.

(Photosensitive Member-Contaminating Property)

A: Streaks by the cycle of the photosensitive member were not observed in the image.

B: Streaks by the cycle of the photosensitive member were slightly observed in the image.

C: Streaks by the cycle of the photosensitive member were remarkably observed in the image.

(Setting Property)

A: Streaks by the cycle of the transfer roller were not observed in the image.

B: Streaks by the cycle of the transfer roller were slightly observed in the image.

C: Streaks by the cycle of the transfer roller were remarkably observed in the image.

(Comprehensive Evaluation)

AA: All of the photosensitive member-contaminating property, the transfer unevenness, the transfer property and the setting property were rated as "A".

A: All of the photosensitive member-contaminating property, the transfer unevenness, the transfer property and the setting property were not rated as "C" (excluding a case where all of the above were rated as "A".).

B: At least one of the photosensitive member-contaminating property, the transfer unevenness, the transfer property and the setting property was rated as "C".

Example 2

A roller for electrophotography of Example 2 was obtained in the same manner as in Example 1 except that 22 parts by mass of an epichlorohydrin/ethylene oxide/allyl glycidyl ether terpolymer containing 56.7% by mass of ethylene oxide ("EPION301", produced by Daiso Co., Ltd. (new corporate name: Osaka Soda Co., Ltd.)) and 10 parts by mass of an epichlorohydrin/ethylene oxide/allyl glycidyl ether terpolymer containing 37.2% by mass of ethylene oxide ("HydrinT3106S", Zeon Corporation) were used for the hydrin rubber.

Example 3

A roller for electrophotography of Example 3 was obtained in the same manner as in Example 1 except that 71 parts by mass of an acrylonitrile-butadiene rubber ("Nipol DN401LL", Zeon Corporation) was used for the unvulcanized rubber and 29 parts by mass of an epichlorohydrin/ethylene oxide/allyl glycidyl ether terpolymer containing 56.7% by mass of ethylene oxide (EPION301: manufactured by Daiso Co., Ltd. (new corporate name: Osaka Soda Co., Ltd.)) was used singly for the hydrin rubber.

Example 4

A roller for electrophotography of Example 4 was obtained in the same manner as in Example 1 except that the amount of tetraethylthiuram disulfide (Nocceler TET-G: Ouchi Shinko Chemical Industrial Co., Ltd.) of the vulcanization accelerator was changed to 1.5 parts by mass.

Example 5

A roller for electrophotography of Example 5 was obtained in the same manner as in Example 1 except that 2.5 parts by mass of sulfur (Sulfax PMC Tsurumi Chemical Industries Co., Ltd.) was used for the vulcanizer.

Example 6

A roller for electrophotography of Example 6 was obtained in the same manner as in Example 1 except that the amount of tetraethylthiuram disulfide (Nocceler TET-G: Ouchi Shinko Chemical Industrial Co., Ltd.) of the vulcanization accelerator was changed to 2.5 parts by mass and 4.0 parts by mass of sulfur (Sulfax PMC Tsurumi Chemical Industries Co., Ltd.) was used for the vulcanizer.

Example 7

A roller for electrophotography of Example 7 was obtained in the same manner as in Example 1 except that 32 parts by mass of an epichlorohydrin/ethylene oxide/allyl glycidyl ether terpolymer containing 56.7% by mass of ethylene oxide (EPION301: manufactured by Daiso Co., Ltd. (new corporate name: Osaka Soda Co., Ltd.)) was used singly for the hydrin rubber and the amount of carbon black (Asahi #35G: Asahi Carbon Co., Ltd.) was 5 parts by mass.

Example 8

A roller for electrophotography of Example 8 was obtained in the same manner as in Example 1 except that 73 parts by mass of an acrylonitrile-butadiene rubber (Nipol DN401LL: Zeon Corporation) was used for the unvulcanized rubber, 17 parts by mass of an epichlorohydrin/ethylene oxide/allyl glycidyl ether terpolymer containing 56.7% by mass of ethylene oxide (EPION301: manufactured by Daiso Co., Ltd. (new corporate name: Osaka Soda Co., Ltd.)) and 10 parts by mass of an epichlorohydrin/ethylene oxide/allyl glycidyl ether terpolymer containing 37.2% by mass of ethylene oxide (Epichlomer CG102: manufactured by Daiso Co., Ltd. (new corporate name: Osaka Soda Co., Ltd.)) were used for the hydrin rubber, and the amount of carbon black (Asahi #35G: Asahi Carbon Co., Ltd.) was 60 parts by mass.

Example 9

A roller for electrophotography of Example 9 was obtained in the same manner as in Example 1 except that 64 parts by mass of an acrylonitrile-butadiene rubber (Nipol DN401LL: Zeon Corporation) was used for the unvulcanized rubber, 36 parts by mass of an epichlorohydrin/ethylene oxide/allyl glycidyl ether terpolymer containing 56.7% by mass of ethylene oxide (EPION301: manufactured by Daiso Co., Ltd. (new corporate name: Osaka Soda Co., Ltd.)) was used singly for the hydrin rubber, and the amount of carbon black (Asahi #35G: Asahi Carbon Co., Ltd.) was 10 parts by mass.

Example 10

A roller for electrophotography of Example 10 was obtained in the same manner as in Example 1 except that 74 parts by mass of an acrylonitrile-butadiene rubber (Nipol DN401LL: Zeon Corporation) was used for the unvulcanized rubber, 16 parts by mass of an epichlorohydrin/ethylene oxide/allyl glycidyl ether terpolymer containing 56.7% by mass of ethylene oxide (EPION301: manufactured by Daiso Co., Ltd. (new corporate name: Osaka Soda Co., Ltd.)) and 10 parts by mass of an epichlorohydrin/ethylene oxide/allyl glycidyl ether terpolymer containing 37.2% by mass of ethylene oxide (Epichlomer CG102: manufactured by Daiso Co., Ltd. (new corporate name: Osaka Soda Co., Ltd.)) were used for the hydrin rubber, and the amount of carbon black (Asahi #35G: Asahi Carbon Co., Ltd.) was 55 parts by mass.

Example 11

A roller for electrophotography of Example 11 was obtained in the same manner as in Example 1 except that 2.0 parts by mass of OBSH having a median diameter of 2.0 μm (Neocellborn N#1000M: Eiwa Chemical Ind. Co., Ltd.) and 0.5 parts by mass of OBSH having a median diameter of 16.0 μm (Neocellborn N#1000S: Eiwa Chemical Ind. Co., Ltd.) were used for the foaming agent.

Example 12

A roller for electrophotography of Example 12 was obtained in the same manner as in Example 1 except that 2.0 parts by mass of OBSH having a median diameter of 5.0 μm (Neocellborn N#1000M: Eiwa Chemical Ind. Co., Ltd.) and 0.5 parts by mass of OBSH having a median diameter of 12.0 μm (Neocellborn N#1000S: Eiwa Chemical Ind. Co., Ltd.) were used for the foaming agent.

Example 13

A roller for electrophotography of Example 13 was obtained in the same manner as in Example 1 except that 1.5 parts by mass of OBSH having a median diameter of 5.0 μm (Neocellborn N#1000M: Eiwa Chemical Ind. Co., Ltd.) and 0.5 parts by mass of OBSH having a median diameter of 16.0 μm (Neocellborn N#1000S: Eiwa Chemical Ind. Co., Ltd.) were used for the foaming agent.

Example 14

A roller for electrophotography of Example 14 was obtained in the same manner as in Example 1 except that 2.5 parts by mass of OBSH having a median diameter of 5.0 μm (Neocellborn N#1000M: Eiwa Chemical Ind. Co., Ltd.) was used singly for the foaming agent.

Example 15

A roller for electrophotography of Example 15 was obtained in the same manner as in Example 1 except that the amount of tetraethylthiuram disulfide (Nocceler TET-G: Ouchi Shinko Chemical Industrial Co., Ltd.) of the vulcanization accelerator was changed to 1.5 parts by mass and 5.0 parts by mass of sulfur ("Sulfax PMC" Tsurumi Chemical Industries Co., Ltd.) was used for the vulcanizer.

Example 16

A roller for electrophotography of Example 16 was obtained in the same manner as in Example 1 except that 2.25 parts by mass of sulfur ("Sulfax PMC" Tsurumi Chemical Industries Co., Ltd.) was used for the vulcanizer and the amount of tetraethylthiuram disulfide (Nocceler TET-G: Ouchi Shinko Chemical Industrial Co., Ltd.) of the vulcanization accelerator was changed to 2.5 parts by mass.

Example 17

A roller for electrophotography of Example 17 was obtained in the same manner as in Example 1 except that the amount of tetraethylthiuram disulfide (Nocceler TET-G: Ouchi Shinko Chemical Industrial Co., Ltd.) of the vulcanization accelerator was changed to 3.0 parts by mass.

Example 18

A roller for electrophotography of Example 18 was obtained in the same manner as in Example 1 except that the amount of tetraethylthiuram disulfide (Nocceler TET-G: Ouchi Shinko Chemical Industrial Co., Ltd.) of the vulcanization accelerator was changed to 1.25 parts by mass and 4.0 parts by mass of sulfur (Sulfax PMC Tsurumi Chemical Industries Co., Ltd.) was used for the vulcanizer.

Example 19

A roller for electrophotography of Example 19 was obtained in the same manner as in Example 1 except that an unvulcanized tube extruded from the extruder 21 was cut to a predetermined length, and the resultant was loaded into an electric furnace (temperature: 160° C., 30 minutes), and vulcanized and foamed.

Comparative Example 1

A roller for electrophotography of Comparative Example 1 was obtained in the same manner as in Example 1 except that 50 parts by mass of an acrylonitrile-butadiene rubber (Nipol DN401LL: Zeon Corporation) was used for the unvulcanized rubber and 50 parts by mass of an epichlorohydrin/ethylene oxide/allyl glycidyl ether terpolymer containing 37.2% by mass of ethylene oxide (Epichlomer CG102: manufactured by Daiso Co., Ltd. (new corporate name: Osaka Soda Co., Ltd.)) was used singly for the hydrin rubber.

Comparative Example 2

A roller for electrophotography of Comparative Example 2 was obtained in the same manner as in Example 1 except that 60 parts by mass of an acrylonitrile-butadiene rubber (Nipol DN401LL: Zeon Corporation) was used for the unvulcanized rubber, 40 parts by mass of an epichlorohydrin/ethylene oxide/allyl glycidyl ether terpolymer containing 37.2% by mass of ethylene oxide (Epichlomer CG102: manufactured by Daiso Co., Ltd. (new corporate name: Osaka Soda Co., Ltd.)) was used singly for the hydrin rubber and 4.0 parts by mass of sulfur (Sulfax PMC Tsurumi Chemical Industries Co., Ltd.) was used for the vulcanizer.

Comparative Example 3

A roller for electrophotography of Comparative Example 3 was obtained in the same manner as in Example 1 except that the amount of tetraethylthiuram disulfide (Nocceler TET-G: Ouchi Shinko Chemical Industrial Co., Ltd.) of the vulcanization accelerator was changed to 1.5 parts by mass and 2.0 parts by mass of sulfur (Sulfax PMC Tsurumi Chemical Industries Co., Ltd.) was used for the vulcanizer.

Comparative Example 4

A roller for electrophotography of Comparative Example 4 was obtained in the same manner as in Example 1 except that the amount of tetraethylthiuram disulfide (Nocceler TET-G: Ouchi Shinko Chemical Industrial Co., Ltd.) of the vulcanization accelerator was changed to 3.0 parts by mass and 6.0 parts by mass of sulfur (Sulfax PMC Tsurumi Chemical Industries Co., Ltd.) was used for the vulcanizer.

Comparative Example 5

A roller for electrophotography of Comparative Example 5 was obtained in the same manner as in Example 1 except that 78 parts by mass of an acrylonitrile-butadiene rubber (Nipol DN401LL: Zeon Corporation) was used for the unvulcanized rubber, and 12 parts by mass of an epichlorohydrin/ethylene oxide/allyl glycidyl ether terpolymer containing 56.7% by mass of ethylene oxide (EPION301: manufactured by Daiso Co., Ltd. (new corporate name: Osaka Soda Co., Ltd.)) and 10 parts by mass of an epichlorohydrin/ethylene oxide/allyl glycidyl ether terpolymer containing 37.2% by mass of ethylene oxide (Epichlomer CG102: manufactured by Daiso Co., Ltd. (new corporate name: Osaka Soda Co., Ltd.)) were used for the hydrin rubber.

The composition and evaluation results of the unvulcanized rubber composition according to each of Examples and Comparative Examples are shown in Table 1 to Table 3 below.

TABLE 1

| | | | Example 1 | Example 2 | Example 3 | Example 4 | Example 5 | Example 6 | Example 7 | Example 8 |
|---|---|---|---|---|---|---|---|---|---|---|
| Unvulcanized rubber composition (part(s) by mass) | Unvulcanized rubber | NBR "Nipol DN401LL" | 68 | 68 | 71 | 68 | 68 | 68 | 68 | 73 |
| | | GECO "EPION301" | 22 | 22 | 29 | 22 | 22 | 22 | 32 | 17 |
| | | GECO "Epichlomer CG102" | 10 | 0 | 0 | 10 | 10 | 10 | 0 | 10 |
| | | GECO "Hydrin T3106S" | 0 | 10 | 0 | 0 | 0 | 0 | 0 | 0 |
| | Vulcanizer | Sulfur | 3.0 | 3.0 | 3.0 | 3.0 | 2.5 | 4.0 | 3.0 | 3.0 |
| | Vulcanization accelerator | TET-G | 2.0 | 2.0 | 2.0 | 1.5 | 2.0 | 2.5 | 2.0 | 2.0 |
| | | DM-P | 1.5 | 1.5 | 1.5 | 1.5 | 1.5 | 1.5 | 1.5 | 1.5 |
| | Vulcanization aid | Zinc stearate | 3.0 | 3.0 | 3.0 | 3.0 | 3.0 | 3.0 | 3.0 | 3.0 |
| | | Stearic acid | 1.0 | 1.0 | 1.0 | 1.0 | 1.0 | 1.0 | 1.0 | 1.0 |
| | Foaming agent | OBSH (2.0 μm) | 0.0 | 0.0 | 0.0 | 0.0 | 0.0 | 0.0 | 0.0 | 0.0 |
| | | OBSH (5.0 μm) | 2.0 | 2.0 | 2.0 | 2.0 | 2.0 | 2.0 | 2.0 | 2.0 |
| | | OBSH (12.0 μm) | 0.0 | 0.0 | 0.0 | 0.0 | 0.0 | 0.0 | 0.0 | 0.0 |
| | | OBSH (16.0 μm) | 0.5 | 0.5 | 0.5 | 0.5 | 0.5 | 0.5 | 0.5 | 0.5 |
| | Filler | Carbon black | 45 | 45 | 45 | 45 | 45 | 45 | 5 | 60 |
| Roller for electrophotography | Physical properties | Matrix (M)/Domain (D) structure (*) | M: NBR D: GECO | M: NBR D: GECO | M: NBR D: GECO | M: NBR D: GECO | M: NBR D: GECO | M: NBR D: GECO | M: NBR D: GECO | M: NBR D: GECO |
| | | Spin-spin relaxation time (μs) | 861 | 854 | 850 | 890 | 890 | 805 | 870 | 845 |
| | | Amount of ethylene oxide (% by mass) | 10.9 | 10.9 | 11.0 | 10.9 | 10.9 | 10.9 | 18.2 | 8.1 |
| | | Roller resistance value (LogR) | 7.39 | 7.39 | 7.34 | 7.39 | 7.39 | 7.39 | 7.13 | 7.69 |
| | | Open cell rate (%) | 78 | 78 | 80 | 84 | 83 | 71 | 78 | 80 |
| | Image evaluation | Photosensitive member-contaminating property | A | A | A | A | A | A | A | A |
| | | Transfer unevenness | A | A | A | A | A | A | A | A |
| | | Transfer property | A | A | A | A | A | A | A | A |
| | | Setting property | A | A | A | A | A | A | A | A |
| | | Comprehensive evaluation | AA | AA | AA | AA | AA | AA | AA | AA |

(*) In Item "Matrix (M)/Domain (D) structure", "M: NBR" represents inclusion of crosslinked NBR in matrix. In addition, "D: GECO" represents inclusion of crosslinked GECO in domain.

TABLE 2

| | | | Example 9 | Example 10 | Example 11 | Example 12 | Example 13 | Example 14 | Example 15 | Example 16 |
|---|---|---|---|---|---|---|---|---|---|---|
| Unvulcanized rubber composition (part(s) by mass) | Unvulcanized rubber | NBR "Nipol DN401LL" | 64 | 74 | 68 | 68 | 68 | 68 | 68 | 68 |
| | | GECO "EPION301" | 36 | 16 | 22 | 22 | 22 | 22 | 22 | 22 |
| | | GECO "Epichlomer CG102" | 0 | 10 | 10 | 10 | 10 | 10 | 10 | 10 |

TABLE 2-continued

| | | | Example 9 | Example 10 | Example 11 | Example 12 | Example 13 | Example 14 | Example 15 | Example 16 |
|---|---|---|---|---|---|---|---|---|---|---|
| | | GECO "Hydrin T3106S" | 0 | 0 | 0 | 0 | 0 | 0 | 0 | 0 |
| | Vulcanizer | Sulfur | 3.0 | 3.0 | 3.0 | 3.0 | 3.0 | 3.0 | 5.0 | 2.25 |
| | Vulcanization accelerator | TET-G | 2.0 | 2.0 | 2.0 | 2.0 | 2.0 | 2.0 | 1.5 | 2.5 |
| | | DM-P | 1.5 | 1.5 | 1.5 | 1.5 | 1.5 | 1.5 | 1.5 | 1.5 |
| | Vulcanization aid | Zinc stearate | 3.0 | 3.0 | 3.0 | 3.0 | 3.0 | 3.0 | 3.0 | 3.0 |
| | | Stearic acid | 1.0 | 1.0 | 1.0 | 1.0 | 1.0 | 1.0 | 1.0 | 1.0 |
| | Foaming agent | OBSH (2.0 μm) | 0.0 | 0.0 | 2.0 | 0.0 | 0.0 | 0.0 | 0.0 | 0.0 |
| | | OBSH (5.0 μm) | 2.0 | 2.0 | 0.0 | 2.0 | 1.5 | 2.5 | 2.0 | 2.0 |
| | | OBSH (12.0 μm) | 0.0 | 0.0 | 0.0 | 0.5 | 0.0 | 0.0 | 0.0 | 0.0 |
| | | OBSH (16.0 μm) | 0.5 | 0.5 | 0.5 | 0.0 | 0.5 | 0.0 | 0.5 | 0.5 |
| | Filler | Carbon black | 10 | 55 | 45 | 45 | 45 | 45 | 45 | 45 |
| Roller for electro-photography | Physical properties | Matrix (M)/Domain (D) structure (*) | M: NBR D: GECO | M: NBR D: GECO | M: NBR D: GECO | M: NBR D: GECO | M: NBR D: GECO | M: NBR D: GECO | M: NBR D: GECO | M: NBR D: GECO |
| | | Spin-spin relaxation time (μs) | 870 | 870 | 865 | 859 | 863 | 863 | 761 | 906 |
| | | Amount of ethylene oxide (% by mass) | 17.9 | 8.0 | 10.9 | 10.9 | 10.9 | 10.9 | 10.9 | 10.9 |
| | | Roller resistance value (LogR) | 6.85 | 7.93 | 7.45 | 7.33 | 7.39 | 7.39 | 7.39 | 7.39 |
| | | Open cell rate (%) | 78 | 78 | 86 | 72 | 60 | 68 | 71 | 82 |
| | Image evaluation | Photosensitive member-contaminating property | A | A | A | A | A | A | A | B |
| | | Transfer unevenness | A | A | A | A | A | A | B | A |
| | | Transfer property | B | B | A | A | A | A | A | A |
| | | Setting property | A | A | A | A | B | B | A | A |
| | | Comprehensive evaluation | A | A | AA | AA | A | A | A | A |

(*) In Item "Matrix (M)/Domain (D) structure", "M: NBR" represents inclusion of crosslinked NBR in matrix. In addition, "D: GECO" represents inclusion of crosslinked GECO in domain.

TABLE 3

| | | | Example 17 | Example 18 | Example 19 | Comparative Example 1 | Comparative Example 2 | Comparative Example 3 | Comparative Example 4 | Comparative Example 5 |
|---|---|---|---|---|---|---|---|---|---|---|
| Unvulcanized rubber composition (part(s) by mass) | Unvulcanized rubber | NBR "Nipol DN401LL" | 68 | 68 | 68 | 50 | 60 | 68 | 68 | 78 |
| | | GECO "EPION301" | 22 | 22 | 22 | 0 | 0 | 22 | 22 | 12 |
| | | GECO "Epichlomer CG102" | 10 | 10 | 10 | 50 | 40 | 10 | 10 | 10 |
| | | GECO "Hydrin T3106S" | 0 | 0 | 0 | 0 | 0 | 0 | 0 | 0 |
| | Vulcanizer | Sulfur | 3.0 | 4.0 | 3.0 | 3.0 | 4.0 | 2.0 | 6.0 | 3.0 |
| | Vulcanization accelerator | TET-G | 3.0 | 1.25 | 2.0 | 2.0 | 2.0 | 1.5 | 3.0 | 2.0 |
| | | DM-P | 1.5 | 1.5 | 1.5 | 1.5 | 1.5 | 1.5 | 1.5 | 1.5 |
| | Vulcanization aid | Zinc stearate | 3.0 | 3.0 | 3.0 | 3.0 | 3.0 | 3.0 | 3.0 | 3.0 |
| | | Stearic acid | 1.0 | 1.0 | 1.0 | 1.0 | 1.0 | 1.0 | 1.0 | 1.0 |
| | Foaming agent | OBSH (2.0 μm) | 0.0 | 0.0 | 0.0 | 0.0 | 0.0 | 0.0 | 0.0 | 0.0 |
| | | OBSH (5.0 μm) | 2.0 | 2.0 | 2.0 | 2.0 | 2.0 | 2.0 | 2.0 | 2.0 |
| | | OBSH (12.0 μm) | 0.0 | 0.0 | 0.0 | 0.0 | 0.0 | 0.0 | 0.0 | 0.0 |
| | | OBSH (16.0 μm) | 0.5 | 0.5 | 0.5 | 0.5 | 0.5 | 0.5 | 0.5 | 0.5 |
| | Filler | Carbon black | 45 | 45 | 45 | 45 | 45 | 45 | 45 | 45 |
| Roller for electro-photography | Physical properties | Matrix (M)/Domain (D) structure (*) | M: NBR D: GECO | M: NBR D: GECO | M: NBR D: GECO | M: GECO D: NBR | M: GECO D: NBR | M: NBR D: GECO | M: NBR D: GECO | M: NBR D: GECO |
| | | Spin-spin relaxation time (μs) | 795 | 901 | 850 | 1030 | 895 | 971 | 706 | 820 |
| | | Amount of ethylene oxide (% by mass) | 10.9 | 10.9 | 10.9 | 12.5 | 10.0 | 10.9 | 10.9 | 7.1 |
| | | Roller resistance value (LogR) | 7.39 | 7.39 | 7.52 | 7.07 | 7.53 | 7.39 | 7.39 | 8.07 |
| | | Open cell rate (%) | 71 | 81 | 69 | 78 | 78 | 78 | 71 | 81 |

TABLE 3-continued

| | | Example 17 | Example 18 | Example 19 | Comparative Example 1 | Comparative Example 2 | Comparative Example 3 | Comparative Example 4 | Comparative Example 5 |
|---|---|---|---|---|---|---|---|---|---|
| Image evaluation | Photosensitive member-contaminating property | A | B | A | C | C | C | A | A |
| | Transfer unevenness | B | A | A | A | A | A | C | A |
| | Transfer property | A | A | A | A | A | A | A | C |
| | Setting property | A | A | B | A | A | A | A | A |
| | Comprehensive evaluation | A | A | A | B | B | B | B | B |

(*) In Item "Matrix (M)/Domain (D) structure", "M: NBR" represents inclusion of crosslinked NBR in matrix, and "D: GECO" represents inclusion of crosslinked GECO in domain. Furthermore, "M: GECO" represents inclusion of crosslinked GECO in matrix. In addition, "D: NBR" represents inclusion of crosslinked NBR in domain.

It could be confirmed from the results in Examples and Comparative Examples that the roller for electrophotography according to the present invention has an excellent electro-conductivity and is reduced in leakage that contaminates the image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-016392, filed Jan. 30, 2015, which is hereby incorporated by reference herein in its entirety.

What is claimed is:

1. A method for producing a roller for electrophotography comprising an electro-conductive mandrel and a surface layer having an electro-conductive foam, the method comprising steps (1) to (3), or steps (1) and (4) to (6):

(1) providing an unvulcanized rubber composition comprising an acrylonitrile-butadiene rubber, a hydrin rubber comprising an epichlorohydrin/ethylene oxide/allyl glycidyl ether terpolymer, sulfur, a thiuram type vulcanization accelerator, and a foaming agent;

(2) forming a layer of the unvulcanized rubber composition around a mandrel;

(3) vulcanizing and foaming the layer of the unvulcanized rubber composition, thereby forming the surface layer comprising the electro-conductive foam comprising a vulcanized product of the unvulcanized rubber composition to provide the roller for electrophotography;

(4) obtaining the unvulcanized rubber composition having a tube shape;

(5) vulcanizing and foaming the unvulcanized rubber composition having the tube shape, thereby providing a rubber tube comprising the vulcanized product of the unvulcanized rubber composition; and (6) pressing the mandrel into the rubber tube to provide a roller for electrophotography having the surface layer around the mandrel, wherein the unvulcanized rubber composition provides a vulcanized product resulting from step (3) or step (5), the vulcanized product has a matrix-domain structure comprising a sea phase and an island phase, the sea phase containing the acrylonitrile-butadiene rubber which is vulcanized, and the island phase containing the hydrin rubber which is vulcanized, the vulcanized product contains 8.0 to 20.0% by mass ethylene oxide based on a total amount of the vulcanized product, and the vulcanized product has a spin-spin relaxation time T2 of 750 μs<T2<930 μs determined by pulse NMR measurement with a hydrogen nucleus as a measurement nucleus.

2. The method for producing a roller for electrophotography according to claim 1, wherein the unvulcanized rubber composition comprises 2.5 to 4.0% by mass of the sulfur based on a total amount of a rubber component in the unvulcanized rubber composition, the unvulcanized rubber composition comprises 1.5 to 2.5% by mass of the thiuram type vulcanization accelerator based on a total amount of a rubber component in the unvulcanized rubber composition, and the acrylonitrile-butadiene rubber has an average content of acrylonitrile of 15 to 20% by mass.

3. The method for producing a roller for electrophotography according to claim 1, wherein a content of the foaming agent in the unvulcanized rubber composition is 2.0 to 2.5% by mass relative to a rubber component in the unvulcanized rubber composition.

4. The method for producing a roller for electrophotography according to claim 3, wherein the foaming agent comprises p,p'-oxybis(benzenesulfonyl hydrazide), and the foaming agent comprises 1.5 to 2.0 parts by mass of p,p'-oxybis(benzenesulfonyl hydrazide) having a median diameter (d50) of 2 to 5 μm based on 100 parts by mass of a rubber component in the unvulcanized rubber composition, and 0.5 to 1.0 part by mass of p,p'-oxybis(benzenesulfonyl hydrazide) having a median diameter (d50) of 12 16 μm based on 100 parts by mass of a rubber component in the unvulcanized rubber composition.

5. The method for producing a roller for electrophotography according to claim 1, wherein the step (3) or step (5) includes vulcanizing and foaming a layer of the unvulcanized rubber composition by use of a microwave vulcanization apparatus.

6. The method for producing a roller for electrophotography according to claim 1, which comprises steps (1) to (3).

7. The method for producing a roller for electrophotography according to claim 1, which comprises steps (1) and (4) to (6).

* * * * *